United States Patent [19]

D'Spain

[11] 4,090,468

[45] May 23, 1978

[54] WARNING FLAG FOR VEHICLES

[76] Inventor: Gary L. D'Spain, 5212 Via Del Cielo, Paradise Valley, Ariz. 85253

[21] Appl. No.: 779,536

[22] Filed: Mar. 21, 1977

[51] Int. Cl.[2] ..... G08B 5/00

[52] U.S. Cl. ..... 116/132 R; 116/173

[58] Field of Search ..... 116/124 B, 28 R, 35 R, 116/173, 132 R; 40/129 R; 114/235 WS

[56] References Cited

U.S. PATENT DOCUMENTS

| | | | |
|---|---|---|---|
| 3,191,898 | 6/1965 | McCullough | 116/28 R |
| 3,287,548 | 11/1966 | Kompier | 116/28 R |
| 3,479,982 | 11/1969 | Honcharenko | 116/35 R |
| 3,520,273 | 7/1970 | Daifotes | 116/28 R |
| 3,599,599 | 8/1971 | Jones | 116/173 |
| 3,602,188 | 8/1971 | Penaflor | 116/173 X |
| 3,786,778 | 1/1974 | Palmer et al. | 116/132 R |
| 3,792,680 | 2/1974 | Allen | 116/173 |
| 3,848,244 | 11/1974 | Young et al. | 116/132 R |

*Primary Examiner*—Daniel M. Yasich
*Attorney, Agent, or Firm*—Warren F. B. Lindsley

[57] ABSTRACT

Warning flag and associated releasing and raising mechanisms for emergency vehicles, water ski equipped boats and the like.

5 Claims, 17 Drawing Figures

WARNING FLAG FOR VEHICLES

BACKGROUND OF THE INVENTION

Water skiing has become an increasingly popular sport in recent years, and with its growth in popularity, the lakes and waterways on which it is practiced have become more and more crowded with boats and skiers criss-crossing back and forth.

The hazards and perils to those engaged in the sport have been demonstrated with alarming frequency through numerous accidents involving death or serious injury. Most often, a downed skier is struck or passed over by another boat whose pilot has not seen the partially submerged person in time to take appropriate action.

In most regulated skiing areas, boats employed for towing are required to display a raised flag as a warning that skier is down in the water. At all other times, the flag is to be lowered. This practice, when followed faithfully, has proven to be effective in saving lives and preventing serious injury.

The present invention is directed toward the provision of a convenient and reliable means for the rapid raising and lowering of such a warning flag.

DESCRIPTION OF THE PRIOR ART

A number of devices recorded in the prior art offer various means for raising such a warning flag.

D. M. Penaflor, U.S. Pat. No. 3,602,188 discloses a spring-loaded flag which is raised by the spring except when a counter-acting force exerted by the tow rope causes the flag to be retracted into an enclosing tube. The flag is raised automatically when the skier releases his grip on the tow-rope as he falls.

N. U. Miller, U.S. Pat. No. 3,735,724 discloses a means for automatically pivoting the flag from a lowered to a raised position as the skier loses his grip, the tension on the tow-rope again controlling the position of the flag.

S. W. Palmer et al., U.S. Pat. No. 3,786,778 disclose a flag which is manually pivoted into a raised position to warn of a downed skier, but no automatic action or spring-loaded mechanism is involved.

R. M. Levy et al., U.S. Pat. No. 3,213,823 disclose a spring-loaded warning spring attached to a special safety helmet to be worn by the skier. The downed skier must himself release the flag from a hold-down clip.

While the foregoing devices accomplish in varying degrees the purpose of the present invention, they fall short of being totally satisfactory in a number of respects. The automatic devices of Penaflor and Miller are unnecessarily complex. Furthermore, if a skier has fallen but still clings to the tow-rope, the flag does not rise until he releases his grip. If the tow-rope is reasonably long, the downed skier may thus flounder unprotected at a hazardous distance from the towing boat until he finally loses his grip. Furthermore, the delay in the raising of the flag reduces the amount of advance warning that could have been provided had a manually operated flag been raised by an observer on the boat at the moment the skier fell into the water. The manually raised flag described by Palmer et al. requires escessive time and effort for raising, and the helmet-mounted flag of Levy et al. may provide useful auxiliary protection, but cannot replace the more visible warning flag mounted on the boat.

What is needed is a warning flag which can be raised quickly and effortlessly the minute the skier loses his balance and begins falling. Such an occurrence may be signalled by an observer or by a tension-controller auxiliary warning such as a bell or a light or it may be observed by the pilot of the boat by means of a rear view mirror.

SUMMARY OF THE INVENTION

In accordance with the invention claimed, an improved warning flag and raising mechanism are provided for mounting on a vehicle, for example, a boat. The flag is raised by a spring following the release of a hold-down means by the driver, pilot or an observer at the instant a warning is needed, i.e., when used on a boat, the instant the skier begins to fall.

It is, therefore, one object of this invention to provide an improved warning flag and raising mechanism for the protection of a vehicle and when used on a boat, a fallen water skier.

Another object of this invention is to provide in such a mechanism a self-raising means such as a spring loaded lever to effect the rapid and effortless hoisting of the flag.

A further object of this invention is to provide a hold down means for securing the flag in a lowered position until released by the observer or pilot.

A still further object of this invention is to provide such a hold-down means in a form which may be rapidly released to enable the raising action.

A still further object of this invention is to provide such self-raising and rapidly releasing hold-down means in simple and inexpensive mechanical structures which will prove reliable and economical for popular use.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
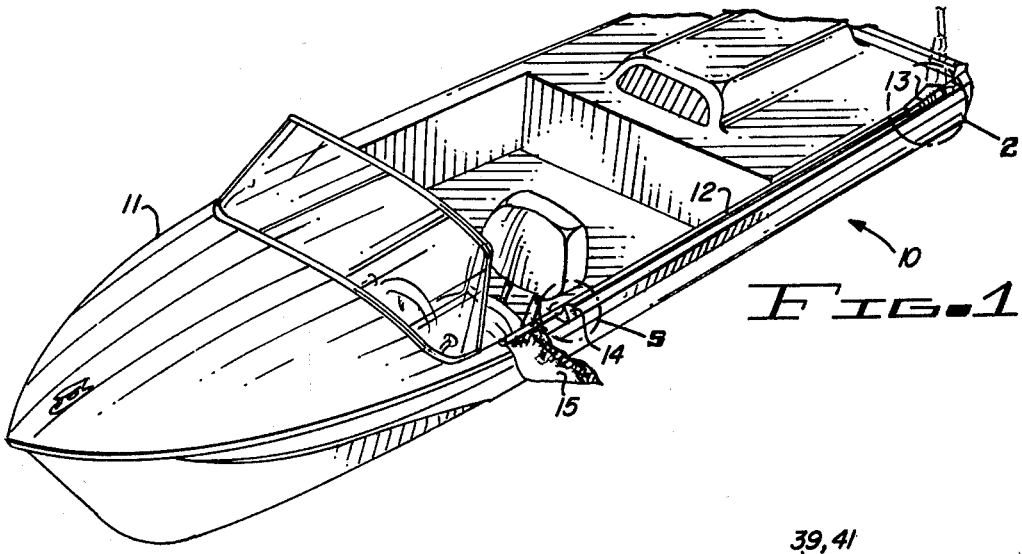
FIG. 1 is a perspective view of the warning flag of the invention mounted on a boat which is employed in towing water skiers.

Referring more particularly to the drawing by characters of reference, FIG. 1 discloses the signal warning flag indicating device 10 of the invention secured at the side of a boat 11 which is employed for towing water skiers. The flat 10 comprises a mast 12 pivotally secured in its lowered position by a hold-down means 14 which grips the mast at a point near its tip just below the banner 15.

The flag-raising mechanism 13 is contrived to raise flag 10 when the hold-down means 14 and the mechanism 13 are released or tripped. The banner 15 is a rectangular or triangular piece of a bright colored fabric designed to catch attention and be plainly visible at a reasonably great distance.

Figure 2:
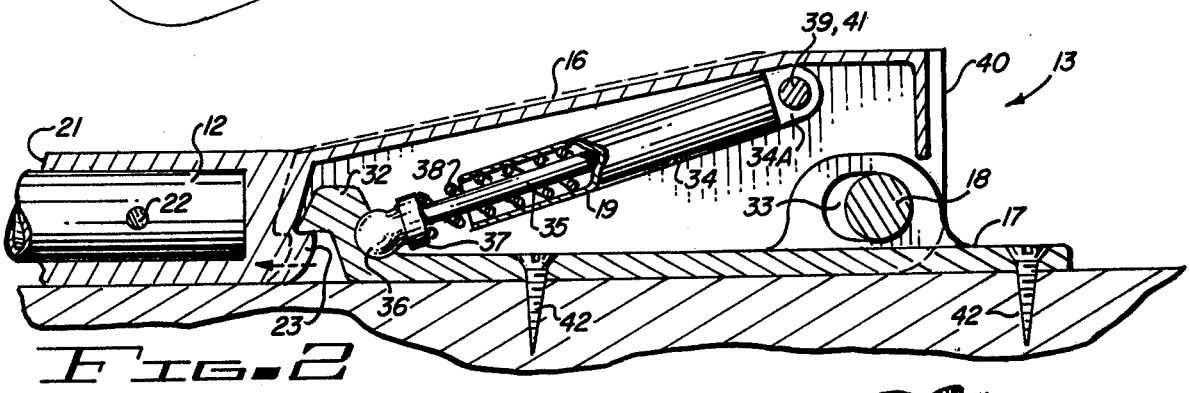
FIG. 2 is a cutaway side view of a flag-raising mechanism which is incorporated as a part of the warning flag of the invention and which is shown also in FIG. 1 within the zone 2.
Figure 4:
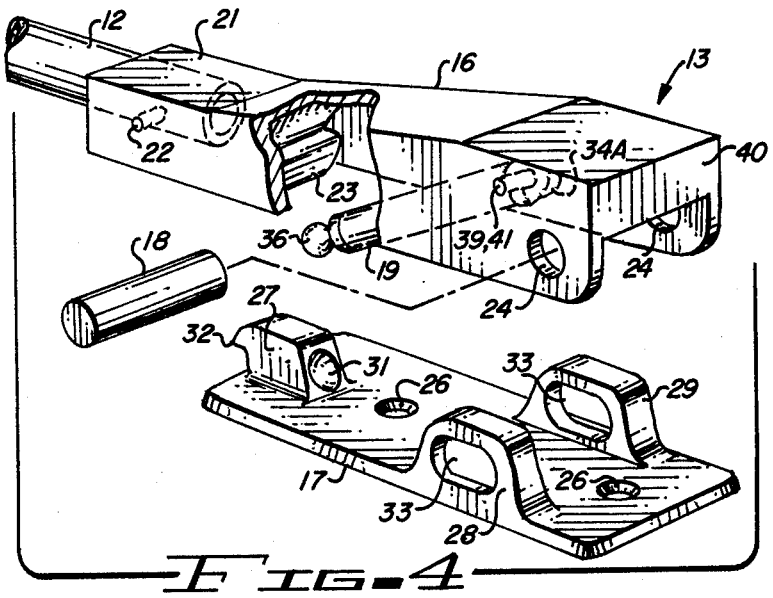
FIG. 4 is an exploded perspective view of the flag-raising mechanism of FIGS. 2 and 3.
Figure 3:
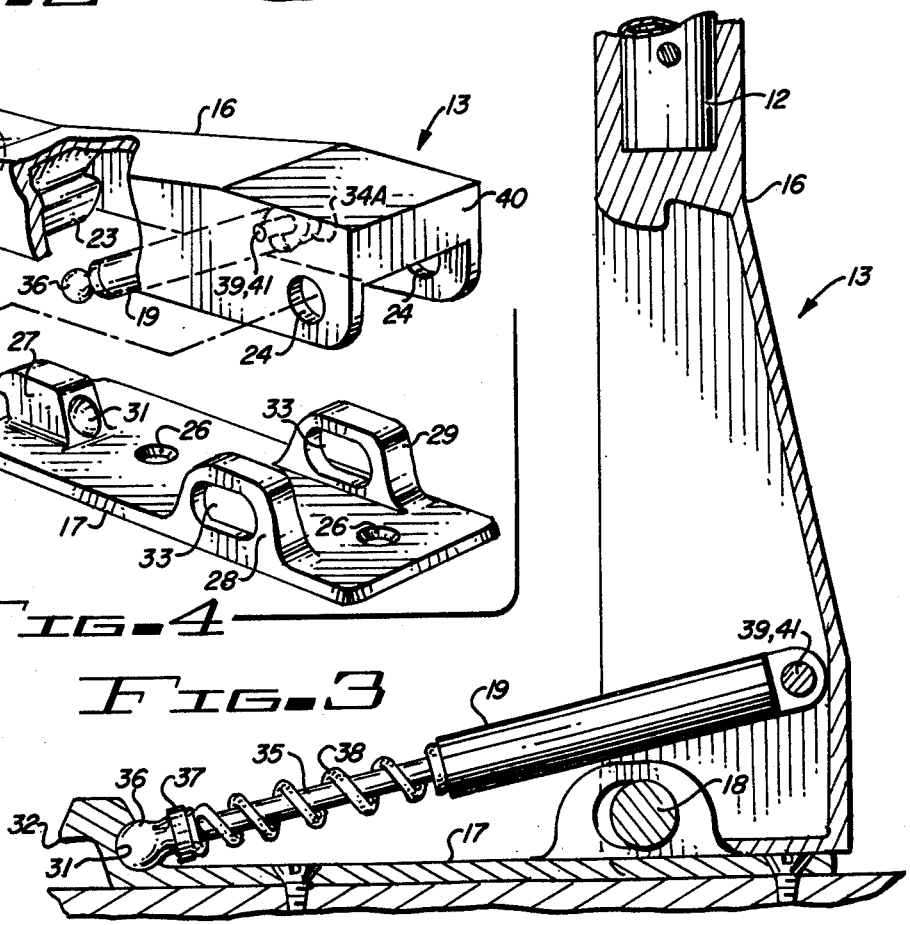
FIG. 3 is a second cutaway side view of the flag-raising mechanism of FIG. 2, here shown in the raised position.

The flag-raising mechanism 13, as shown in FIGS. 2–4, comprises a stock or arm member 16, a base member 17, a pivot pin 18 and a tension spring assembly 19.

The stock 16 is in the form of a hollow U-shaped channel at the rearward end which tapers to a smaller solid portion at the forward end. The solid portion has a longitudinal bore 21 which receives and supports the lower end of the mast 12. A lateral pin 22 passing through the wall of stock 16 and through the end of mast 12 secures the end of mast 12 within bore 21. A tab or projection 23 extending rearwardly from the lower half of the rearward end of the solid forward portion of stock 16 serves as one member of a locking means to be described later. Two aligned holes 24 passing laterally through the side walls of the channel-shaped rearward portion of stock 16 at its lower rearward corner are employed in the pivotal mounting of stock 16 to base member 17.

Base member 17 is a one-piece casting comprising a rectangular mounting plate with two centrally located mounting holes 26 and three perpendicularly projecting tabs 27–29, their lengths running parallel with the longitudinal axis of the plate. First tab 27 is located along the longitudinal center line of base member 17 at its forward end. A spherical depression 31 in the sloped rearward end of tab 27 serves as a socket of a ball and socket connection for the forward end of spring assembly 19. A tapered projection 32 extending forward from the upper half of the forward end of tab 27 serves as a second member of a locking means cooperating with projection 23 of stock 16. Tabs 28 and 29 are positioned one at each side of the rearward end of base member 17. These tabs are pierced by holes 33 which are elongated horizontally and dimensioned to receive pivot pin 18. When stock 16 is mounted to base member 17, holes 24 of stock 16 are aligned with holes 33 of base member 17 and pin 18 is passed through holes 24 and 33. An interference fit between the ends of pin 18 and holes 24 secures pin 18 while clearance between pin 18 and holes 33 permits a small longitudinal travel of pin 18 relative to base member 17 in addition to the pivotal rotation of stock 16 relative to base member 17.

Spring assembly 19 comprises a hollow cylindrical rearward housing 34, an inner stem 35 having a spherical ball 36 and retaining shoulder 37 at its forward end, and a tension spring 38. The rearward end 34A of housing 34 is flattened and pierced to receive a pivot pin 39 which also passes through two lateral holes 41 in the side walls of the stock 16, the holes 41 being located just forward and upward from the holes 24. Spring 38 fits inside the housing 34 and stem 35 is positioned inside spring 38, the forward end of spring 38 being retained by shoulder 37 so that as stem 35 is urged rearwardly inside housing 34, spring 38 is compressed between shoulder 37 and the rearward end of the hollow cylindrical interior of housing 34. Ball 36 fits inside socket 31 of tab 27 of base member 17 forming a pivotal ball-and-socket-type joint therewith, as shown in FIGS. 2 and 3.

Base member 17 is secured by means of screws through holes 26 to the top surface of the side or rail of a boat near its stern, as shown in FIG. 1, with tabs 28 and 29 located rearwardly thereof so that when mast 12 is lowered, as shown in FIG. 1, it extends forwardly along the side or rail of the boat.

When mast 12 is lowered as in FIG. 1, the raising mechanism 16 assumes the position shown in FIG. 2. As mast 12 is lowered to this position, the sloping edge of projection 23 of stock 16 is urged against the tapered edge of projection 32 of base member 17. The edges of projections 23 and 32 are formed to cause stock 16 to be moved forward against the force of spring 38. As stock 16 is pivoted downward causing projection 23 to sweep across the edge of projection 32, it snaps into the locked position shown in FIG. 2 wherein the projection 23 is drawn rearwardly beneath projection 32 by the action of spring 38. It will be appreciated that the locked condition may be released by urging the mast forward against the action of spring 38 and sustaining the forward pressure while raising the mast until projection 32 is cleared from projection 23. The elongation of holes 33 permits the necessary forward motion of pin 18 and stock 16 during the locking and unlocking procedures.

Once projections 23 and 32 have been operated and then unlocked from each other, the force of spring assembly 19 produces a moment of force about pivot pin 18 which causes the stock and mast 12 to be rotated in a clockwise direction about pin 18 toward the upright position of mast 12, as shown in FIG. 3. In the fully upright position of mast 12, the rearward surface 40 of stock 16 comes to rest against the rear top surface of base member 17 serving as an abutment means spaced from the pivotal connection of the arm member 16 to the base member 17, thereby constraining stock 16 and mast 12 against any further clockwise rotation. The spring assembly sustains the upward position of mast 12, forcing it against the rotational limit just described until the mast is again forcibly lowered against the action of spring 38.

It will be appreciated that the locking action of projections 23 and 32 is sufficient to hold mast 12 in the lowered position. It may be found, however, that at high speeds and on rough water, the top or forward end of mast 12 will move about and beat against the side of the boat. To prevent this undesirable occurrence, the hold-down means 14 is provided.

Figure 5:
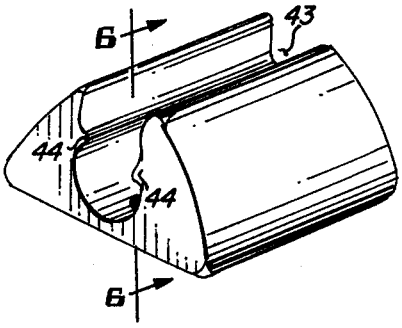
FIG. 5 is a perspective view of a hold-down means incorporated as a part of the warning flag of the invention and shown also in FIG. 1 within the zone 5.
Figure 6:
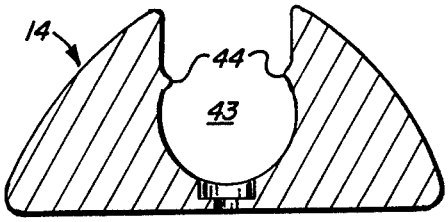
FIG. 6 is a cross-sectional view of the hold-down means of FIG. 5 as seen along line 6—6 of FIG. 5.

A first embodiment of the attachment means or hold-down means 14, as shown in FIGS. 5 and 6, comprises a wedge-shaped body with a longitudinal slot 43 opening upwardly. The width of slot 43 is slightly greater than the diameter of mast 12 and the base of slot 43 is a cylindrical surface again with a diameter slightly greater than that of mast 12. Two projections 44 are positioned, one on each side of slot 43. These projections run lengthwise of the wedge-shaped body within slot 43 and are tangent with the circumference of the cylindrically formed base of the slot. When mast 12 is lowered, it is forced into slot 43 and through the restriction formed by projections 44, the projections then securing the mast in the base of slot 43. If the body of mast 12 is not sufficiently compressible to be forced into the rigid hold-down means 14, as shown in FIGS. 5 and 6, the hold-down means 14 may be molded from a flexible plastic or the mast may be covered with a flexible band over the segment of its length that is captured by the hold-down means 14.

Two counter-sunk holes 45 are provided at the base of the slot 43 for mounting the hold-down means 14 to the side or rail of boat 11.

Figure 7:
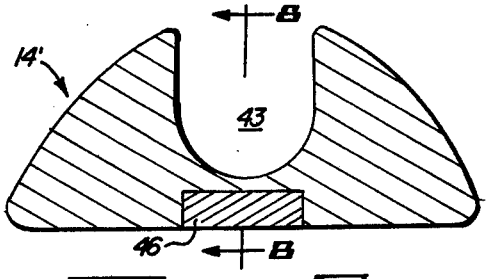
FIG. 7 is a cross-sectional view of an alternative type of hold-down means which may be incorporated as a part of the warning flag of the invention.
Figure 8:
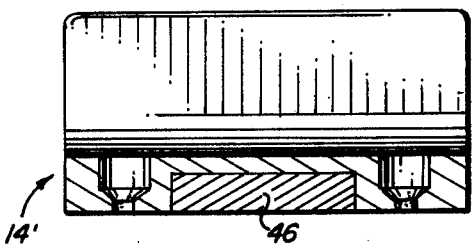
FIG. 8 is a second cross-sectional view of the hold-down means of FIG. 7 as seen along line 8—8 of FIG. 7.

If mast 12 is made of steel or some other magnetic material or if it is fitted with a band of magnetic material over the region to be held by the hold-down means, an alternate hold-down means 14' may be employed, as shown in FIGS. 7 and 8. The general form of the hold-down means 14' is the same as that of hold-down means 14 except that the projections 44 are omitted therefrom. The hold-down means 14' utilizes an alternate means for retaining the mast inside slot 43' comprising a permanent magnet 46 embedded in its base centrally positioned beneath the base of slot 43'. The hold-down means 14' may be cast of a magnetic material such as iron or of a non-magnetic material such as plastic.

Figure 9:
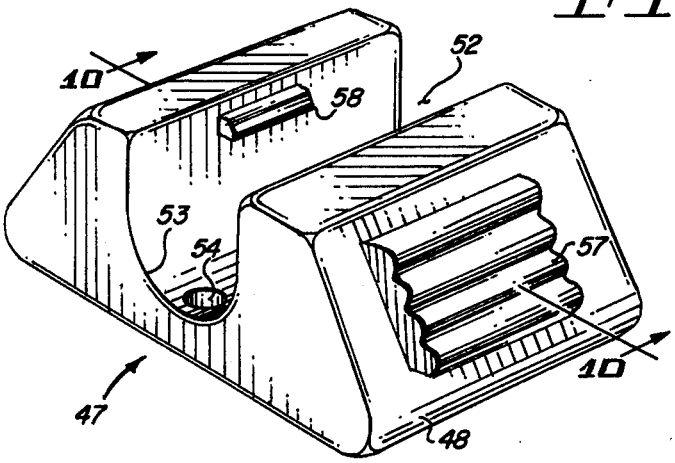
FIG. 9 is a perspective view of a third type of hold-down means which may be incorporated as a part of the invention.
Figure 11:
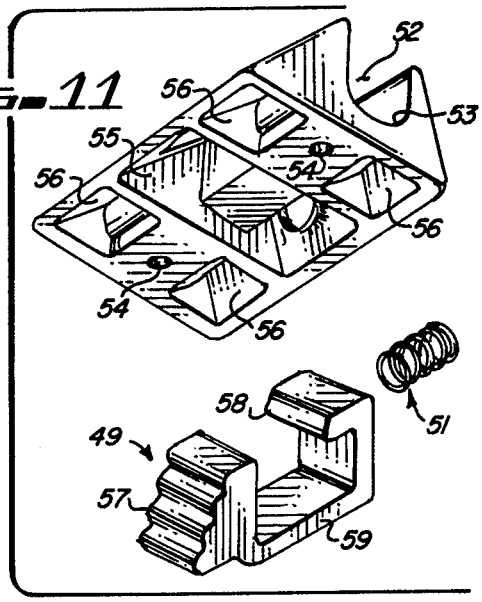
FIG. 11 is an exploded view of the hold-down means of FIGS. 9 and 10.
Figure 10:
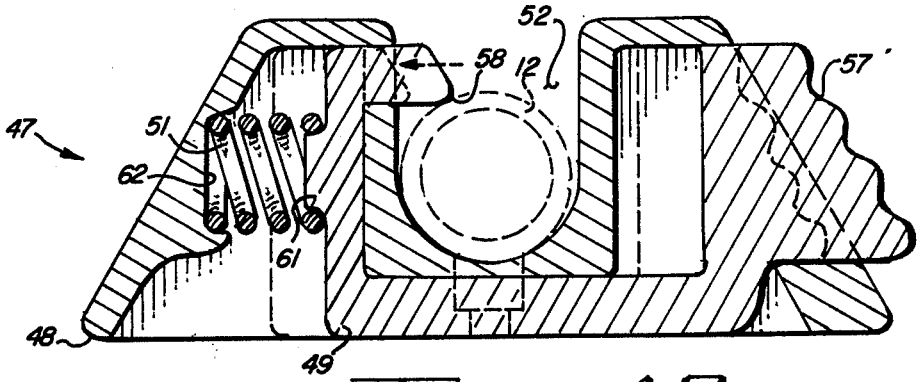
FIG. 10 is a cross-sectional view of the hold-down means of FIG. 9 as seen along line 10—10 of FIG. 9.

FIGS. 9–11 define a quick-release hold-down means 47 which may be utilized in place of hold-down means 14 or 14' and comprises a main body 48, a sliding latch 49 and a compression spring 51.

The main body 48 approximates in terms of its exposed surface contours the shape of the hold-down means 14 or 14' having a generally wedge-shaped appearance with a central longitudinal slot 52 which again has a cylindrically curved base 53. Two holes 54 are provided at each end of slot 52 for securing means 47 to the side or rail of boat ll. As contrasted with means 14 or 14', however, means 47 is hollowed out underneath, there being five openings visible in FIG. 11 including a central opening 55 and four corner openings 56. The four corner openings 56 are non-essential functionally and are provided only for the sake of reducing material in the casting of body 48. The central opening 55, however, is utilized to receive the sliding latch 49.

Latch 49 has the general form of a short U-shaped channel. Projecting outwardly from one leg or side of the channel is a tapered grip 57, the extension of grip 57 being a maximum at its base and tapering to nearly zero at the top. The outer surface of grip 57 has a rippled surface to suggest its purpose and to afford a better gripping surface. Extending along the inside surface of the opposite leg of the U-shaped channel is a latching projection 58. Projection 58 tapers to a moderately sharp edge which runs longitudinally of the length of the channel-shaped body of latch 49.

When latch 49 is installed in body 48, the greater portion of the latch is contained within opening 55. Base 59 of the U-shaped latch 49 passes underneath base 53 of slot 52, the projection 58 passing through a clearance hole in the side wall of slot 52, and grip 57 passes through a clearance hole in the outer side wall of body 48.

Further details of body 48 and latch 49 include a circular projection 61 extending outwardly from the side of latch 49 opposite grip 57, and a circular depression 62 in the inside surface of the outer wall of body 48. The depression 62 is horizontally and vertically aligned with projection 61. Projection 61 is dimensioned to receive and retain the outer diameter of spring 51 so that the spring may be installed, as shown in FIG. 10, with its opposite ends secured by depression 62 and projection 61. Spring 51, when installed in this manner, is in compression and it urges latch 49 toward the opposite side of body 48 to produce a maximum extension of projection 58 into the slot and a maximum extension of grip 57 through the outer wall of body 48. In this position of grip 49, projection 58 extends above the contained body of mast 12, as shown in FIG. 10, to secure or retain mast 12 within slot 52.

In the utilization of the quick release hold-down means 47, the latching feature of the raising mechanism 13 may be eliminated by removing from stock 16 and base 17 the projections 23 and 32, respectively, and the lost motion connection formed by the oblong-bearing holes 33. Holes 33 may be round and slightly larger than pivot pin 18. With the means 47 now installed at the side of the boat 11 in place of the hold-down means 14, the hold-down means 47 provides the total latching or hold-down function without aid from mechanism 13, projection 58 bearing down against the surface of mast 12 and restraining mast 12 from being raised by the action of spring assembly 19. It will now be apparent that the quick release of mast 12 may be accomplished simply by striking or depressing grip 57 which urges projection 58 back into the interior of body 48 to clear an opening through slot 52 for mast 12 and thereby allowing the spring assembly 19 to raise the mast 12 to its upright position. When it is desired to return the mast to its lowered position, it is simply pulled down and pressed into slot 52, the projection 58 being automatically forced out of the way by virtue of its tapered edge.

It is also possible to utilize the hold-down means 14 or 14' with or without the latching action afforded by the projections 23 and 32. While the latching feature incorporated by such means in mechanism 13 provides more security for the lowered mast, it also complicates the releasing operation and adds to the time required to raise the mast. Although the flag-raising mechanism 13 and associated clamping means may be made of suitable plastic material to avoid problems of rust, it may be made of any suitable material and used on any type of vehicle in addition to the boat use disclosed.

Figure 12:
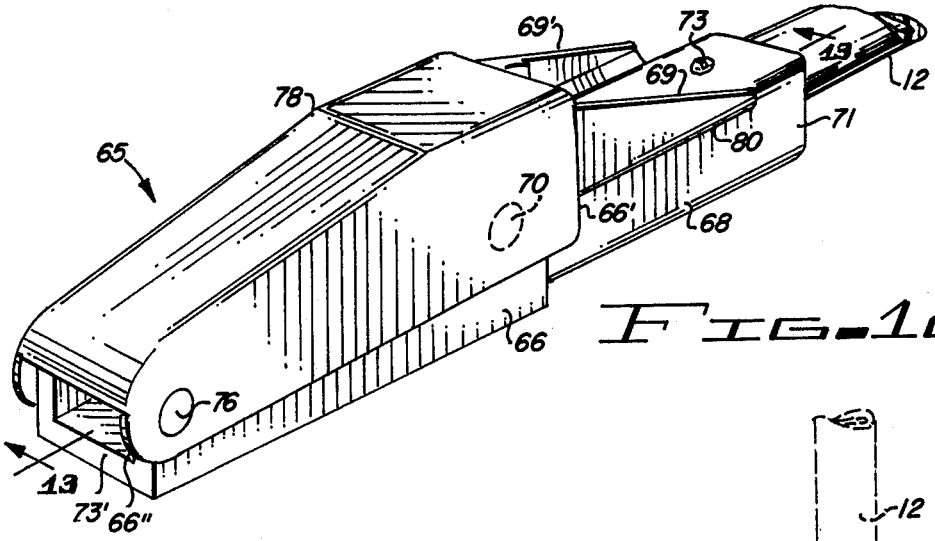
FIG. 12 is a perspective view of a further modification of the flag-raising mechanism shown in FIGS. 1–4.
Figure 12A:
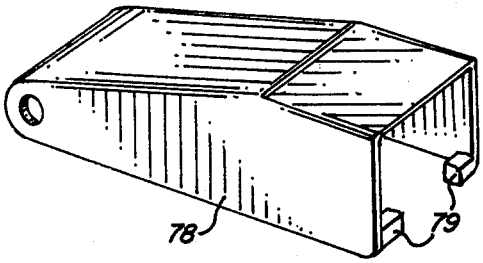
FIG. 12A is a perspective view of the cover of the mechanism shown in FIG. 12.
Figure 13:
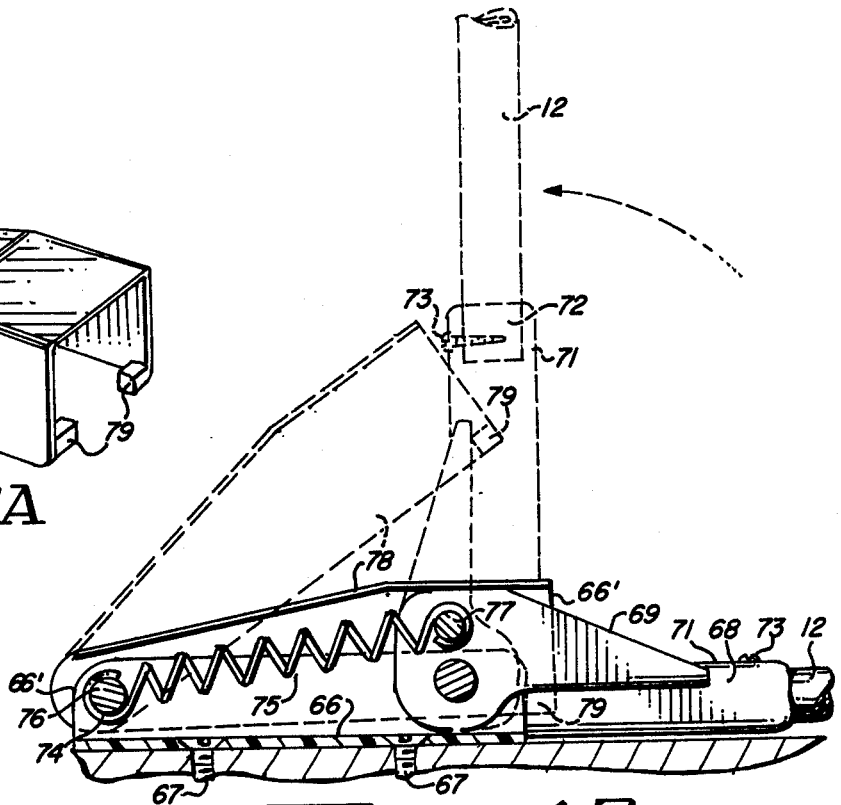
FIG. 13 is a cross-sectional view of FIG. 12 taken along the line 13—13.

FIGS. 12, 12A and 13 disclose a further modification of the flag-raising mechanism shown in FIGS. 1–4 wherein a flag-raising device 65 is disclosed comprising a U-shaped channel base member 66 which is fastened to a vehicle such as a boat by a pair of screws 67. The flag-raising mechanism 13' comprises a pivotally mounted stock or arm member 68 mounted within one end of the channel member 66. This arm member comprises a bifurcated channel member at one end having two spaced arms 69, 69' pivotally mounted on a suitable pin means 70 journaled in end 66' of channel member 66.

The other end of arm member 68 comprises a solid portion 71 having a longitudinally extending bore 72 for receiving and supporting the lower end of mast 12. A pin 73 extending through the walls of arm member 68 and through the end of mast 12 secures mast 12 within bore 72.

The other end 66'' of the channel member 66 is provided with a U-shaped cleat 73' which is secured to its bottom surface between the lateral arms of the channel member. This cleat restricts the movement of an end 74 of a spring 75 which is fastened around a pin 76 journaled in the lateral arms of the channel member 66 at its end 66''. The other end of spring 75 is fastened to a pin 77 secured between the bifurcated arms 69, 69' of arm member 68 at a point between pin 70 and the solid portion 71 of arm member 68.

When the mast 12 is released from a suitable hold-down means, such as means 14, coil spring 75 will bias the mast to its upright position which is approximately 90° from its horizontal hold-down position on the rail of the boat as shown in FIG. 1. It should be noted that when the mast is in the hold-down position, the axis of the spring is in more nearly a parallel position with the longitudinal axis of the mast than in the mast upright position so as to minimize its biasing effect on the mast until the mast is released from its hold-down means.

In order to protect the spring from the elements, a U-shaped cover 78 is privotally mounted on pin 76 and fits over and pivots about the end 66'' of the U-shaped channel member 66. This cover is provided with a pair of dogs 79 at its free end which engage with flanges 80 extending along the longitudinal axis of arm member 68. These flanges serve as a guide for the cover as it moves therealong during the raising and lowering movement of mast 12.

Figure 14:
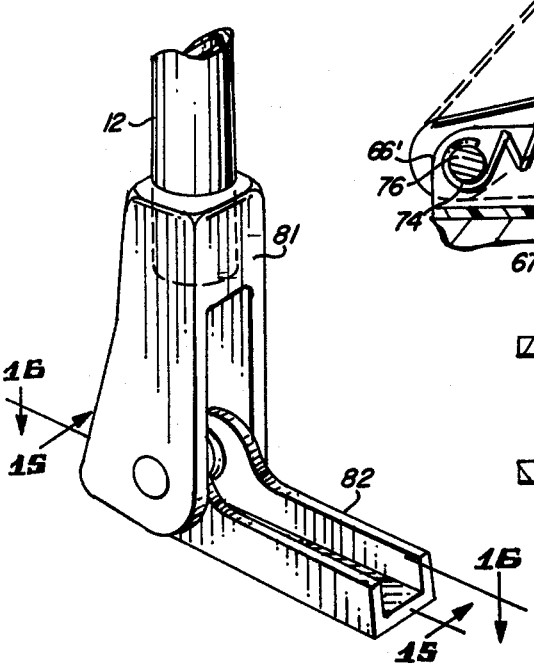
FIG. 14 is a still further modification of the flag-raising mechanism shown in FIGS. 1–4 and 12.
Figure 16:
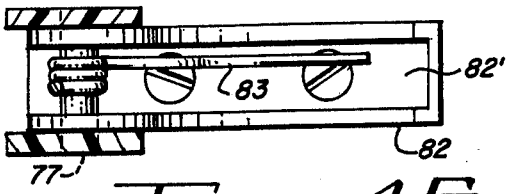
FIG. 16 is a cross-sectional view of FIG. 14 taken along the line 16—16.
Figure 15:
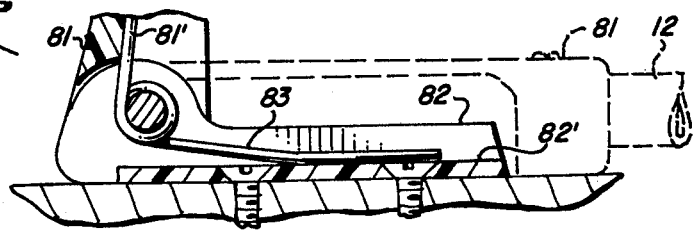
FIG. 15 is a cross-sectional view of FIG. 14 taken along the line 15—15.

FIGS. 14–16 disclose a modification of the structure shown in FIGS. 12–13 wherein the bifurcated arm member 81 which functions similar to the one shown in FIGS. 12 and 13 is mounted on a U-shaped channel member 82 and is biased by a leaf spring 83.

Leaf spring 83 is mounted on pin 77 having one arm 83' biased against the top surface 82' of channel member 82 and the other against the inside surface 81' of the bifurcated arm member 81.

Although the disclosure illustrates a boat as one vehicle on which the claimed subject matter may be mounted to serve a useful function, it should be recognized that other vehicles such as trucks, tractors and the like may also use such a warning device.

An effective warning flag is thus provided in accordance with the stated objects of the invention, and although but a few embodiments of the invention have been illustrated and described, it will be apparent to those skilled in the art that various changes and modifications may be made therein without departing from the spirit of the invention or from the scope of the appended claims.

What is claimed is:

1. A signal apparatus for use in combination with a vehicle comprising:

a base member for attachment to said vehicle, an arm member pivotally connected to said base member for movement from a position extendingly juxtaposed to said base member to a transverse position thereof and comprising a support means for a mast, a mast attached to said support means for extending longitudinally of said arm member, a signal device attached to the free end of said mast, said signal device indicating a predetermined condition by moving said mast to said transverse position, abutment means mounted on said arm member and spaced from a pivotal connection of said arm member to said base for supporting said mast and arm member in its transverse position, biasing means connected between points on said arm member and said base member for biasing said mast to said transverse position, means for detachably connecting and holding said mast and arm member in its storage position juxtapositioned to said base member, said means for detachably connecting and holding said shaft and arm member comprises a clamping means spaced from said base member for engaging said shaft adjacent said signal device, said clamping means comprising a U-shaped slot for receiving longitudinally thereof a part of the length of said mast, a latch slidably mounted on said clamping means laterally of the slot of said clamping means for releasably engaging said part of said mast, and attachment means forming a part of said base member which interlock with a part of said arm member when said arm member is moved to its position juxtaposed to said base member, said part of said base member comprising a first tab which engages with a second tab on said arm member when said arm member is juxtaposed to said base member, said pivotal connection of said arm member to said base member comprising a lost motion connection, and said second tab on said arm member slidably engaging with first tab of said base member under the effects of said biasing means when said arm member is juxtaposed to said base member.

2. The signal apparatus set forth in claim 1 wherein:

said biasing means comprises a tension means positioned between said first tab on said base member and a position on said arm member.

3. The signal apparatus set forth in claim 2 wherein:

the connection of said tension means to said first tab comprises a ball and socket connection.

4. The signal apparatus set forth in claim 1 wherein:

said base member comprises a U-shaped channel member having a base and a pair of spaced leg members, said mast comprises a bifurcated member having a pair of arms pivotally mounted between said leg members of said channel member at one end thereof, and said biasing means being arranged to lie within said channel member.

5. The signal apparatus set forth in claim 4 in further combination with:

a cover member pivotally mounted on the other end of said channel member and arranged for at least partially surrounding said leg members, said cover member having a dog at its free end for engaging a flange on said arm member and moving therealong during rotation of said arm member for maintaining said cover member over the leg members of said channel member.

* * * * *